United States Patent [19]

Demurger

[11] Patent Number: 4,989,747

[45] Date of Patent: Feb. 5, 1991

[54] LATCHING MEANS FOR MOLDED PLASTIC BOX

[75] Inventor: Jean P. Demurger, Roanne, France

[73] Assignee: Demurger et Cie, France

[21] Appl. No.: 475,217

[22] Filed: Feb. 5, 1990

[30] Foreign Application Priority Data

Feb. 7, 1989 [FR] France ..... 89 01788

[51] Int. Cl.[5] ..... B65D 45/18

[52] U.S. Cl. ..... 220/324; 206/349; 206/511; 220/4.23; 220/283; 220/339

[58] Field of Search ..... 220/306, 315, 324, 326, 220/281, 283, 4 B, 337, 339; 206/508, 511, 509, 349; 229/2.5 R

[56] References Cited

U.S. PATENT DOCUMENTS

| | | | |
|---|---|---|---|
| 1,568,150 | 1/1926 | Foster . | |
| 2,050,980 | 8/1936 | Buhl . | |
| 2,307,087 | 1/1943 | White . | |
| 3,186,574 | 6/1965 | Davidson | 220/324 X |
| 3,347,359 | 10/1967 | Kolesh et al. | 206/349 |
| 3,380,573 | 4/1968 | Gulotta | 206/370 X |
| 3,405,836 | 10/1968 | Regis Jr. | 220/339 X |
| 3,499,525 | 3/1970 | Kanter | 220/324 X |
| 3,565,146 | 2/1971 | Arnolds | 220/4 B |
| 3,767,110 | 10/1973 | Congleton | 220/4 B |
| 3,786,913 | 1/1974 | Crawford | 220/339 X |
| 3,811,563 | 5/1974 | Fox II | 220/339 X |
| 3,842,974 | 10/1974 | Jacobsen . | |
| 3,891,070 | 6/1975 | Montanari | 220/4 B X |
| 4,098,430 | 7/1978 | Matthels et al. | 220/339 |
| 4,133,449 | 1/1979 | Ostrowsky | 220/339 |
| 4,162,004 | 7/1979 | Thomas | 206/349 |
| 4,588,082 | 5/1986 | Ridings | 206/349 |
| 4,588,086 | 5/1986 | Coe | 206/508 X |
| 4,678,080 | 7/1987 | Nelson | 220/339 X |
| 4,700,842 | 10/1987 | Grusin | 206/508 |
| 4,703,853 | 11/1987 | Byrns | 220/339 X |
| 4,730,731 | 3/1988 | Allison | 220/337 X |

FOREIGN PATENT DOCUMENTS

| | | |
|---|---|---|
| 1231761 | 10/1960 | France . |
| 2587880 | 4/1987 | France . |

*Primary Examiner*—Bryon P. Gehman
*Attorney, Agent, or Firm*—Wall and Roehrig

[57] ABSTRACT

An elongated flat plastic box hinged along one side is provided with a pair of latches spaced along the opposite side. The male part of the latch is connected to an actuating tab formed in the top at one end and in the bottom at the opposite end of the elongated box. The female part of the latch is formed in the opposite part of the box in mating relationship with the male portion of the latch. This alternating arrangement allows the normal twisting action of left and right hands attempting to open the box, to disengage the latches and simultaneously open the box for exposure of the contents by simply applying pressure to the actuating tabs. The entire box, including the latches, is molded in a single operation.

3 Claims, 5 Drawing Sheets

LATCHING MEANS FOR MOLDED PLASTIC BOX

The invention relates to a novel one-piece long and flat plastic packing box.

Although the box according to the invention is described in the following description most often in its application to packing saw blades, it is in no way limited to this preferred embodiment. It is suitable for packing any long and flat object or any other object arranged, for example, on a plastic foam base.

It is well known to pack blades for hand saws in packs in long and flat metal boxes. Although this solution is very widespread and has been used for many years, it is not satisfactory since, on the one hand, the box is heavy and, on the other hand and above all, it is expensive.

In the document US-A-2,307,087, a metal tablet box has been described, in which the closing system consists of alternately positioned protuberances, on the base and on the lid respectively, enabling the lid to be released by applying pressure to a central protuberance carried by the base, which causes the clip protuberances carried by the lid to be released.

The invention overcomes these disadvantages. It provides a long and flat packing box of the type in question which is lighter, more economical, more attractive, can be easily reused and above all can be easily filled in an automated manner.

The one-piece long and flat plastic packing box according to the invention consists of a lid and a base, articulated about a longitudinal hinge and defining between them a closing line of the lid onto the base having closing means, also molded, formed by male parts interacting by clip-fastening with female parts enabling, under the influence of a lateral pressure exerted on a bearing surface arranged next to the female part of the closing means, the base to be released from the lid.

According to the invention, this box has two closing means spaced along the closing line, arranged respectively:

with the first on the lid and next to a lateral face defining the top of the box, with the second on the base and next to the opposite lateral face defining the bottom of the box.

In other words, the invention provides a one-piece plastic packing box which has two closing means arranged along the closing line, one on the lid and the other on the base respectively, associated with bearing zones such that simply by exerting lateral pressure simultaneously with each hand on each of these two bearing zones, the said closing means can be released in order to free the lid from the base and thus open the box.

The bearing surface of the first closing means is advantageously arranged in practise on the base and next to the top of the box, whereas the second bearing surface is arranged on the lid and next to the bottom of the box.

The manner in which the invention may be implemented and the advantages which result from it will become more evident from the exemplary embodiment which follows, intended for packaging blades for hand saws packaged in packs of ten (two rows of five packs each) and from the attached figures.

FIG. 3 shows the lid seen from above, whereas

Figure 1:
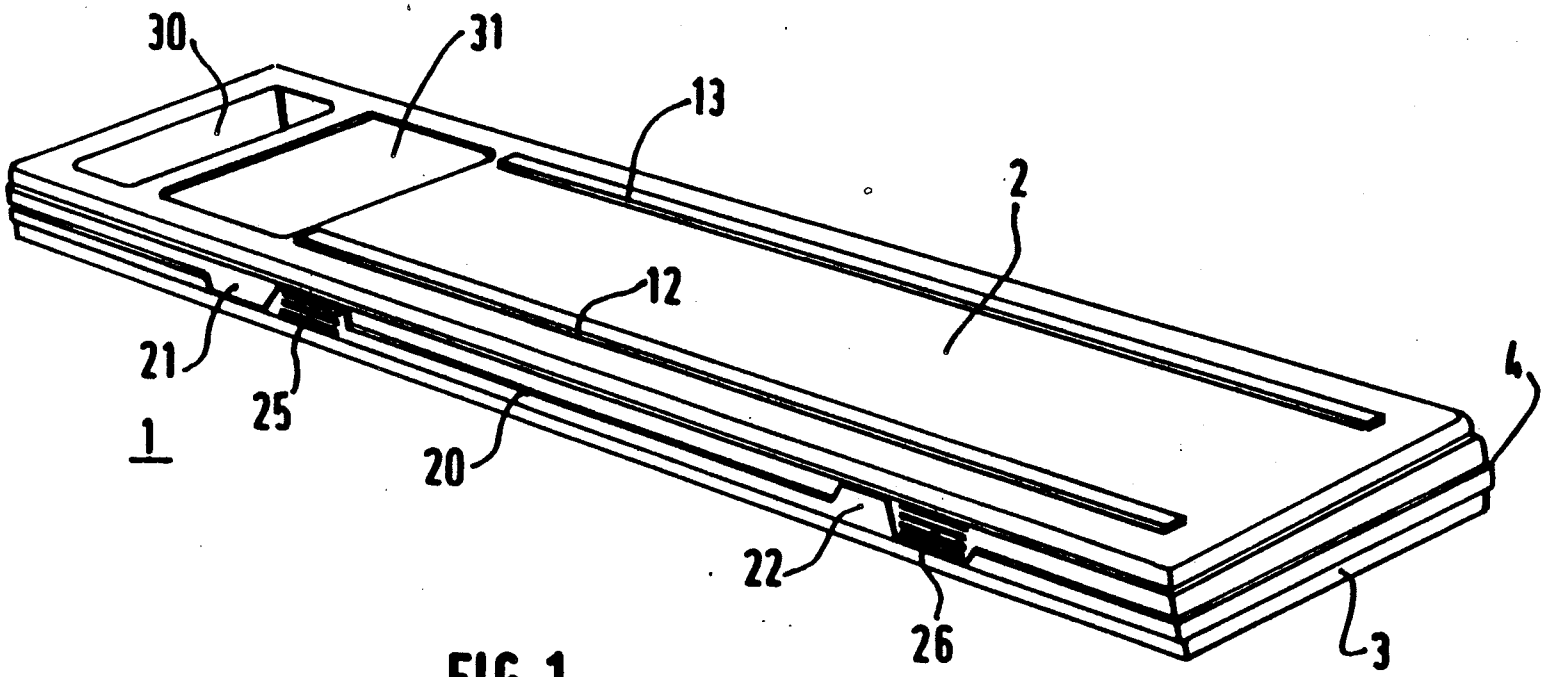
FIG. 1 shows a basic perspective view of a box according to the invention.

The packing box according to the invention, designated by the general reference (1), is made from injected plastic which is cheap, has a good resistance over time and is sufficiently rigid to enable hanging, such as, in particular, from polypropylene or even from polyethylene.

This one-piece box (1) essentially comprises, molded directly, a lid (2) and a base (3), joined by a hinge (4), defining a closing (or opening) line (20) and two lateral walls defining the top (40) and the bottom (41).

Figure 2:
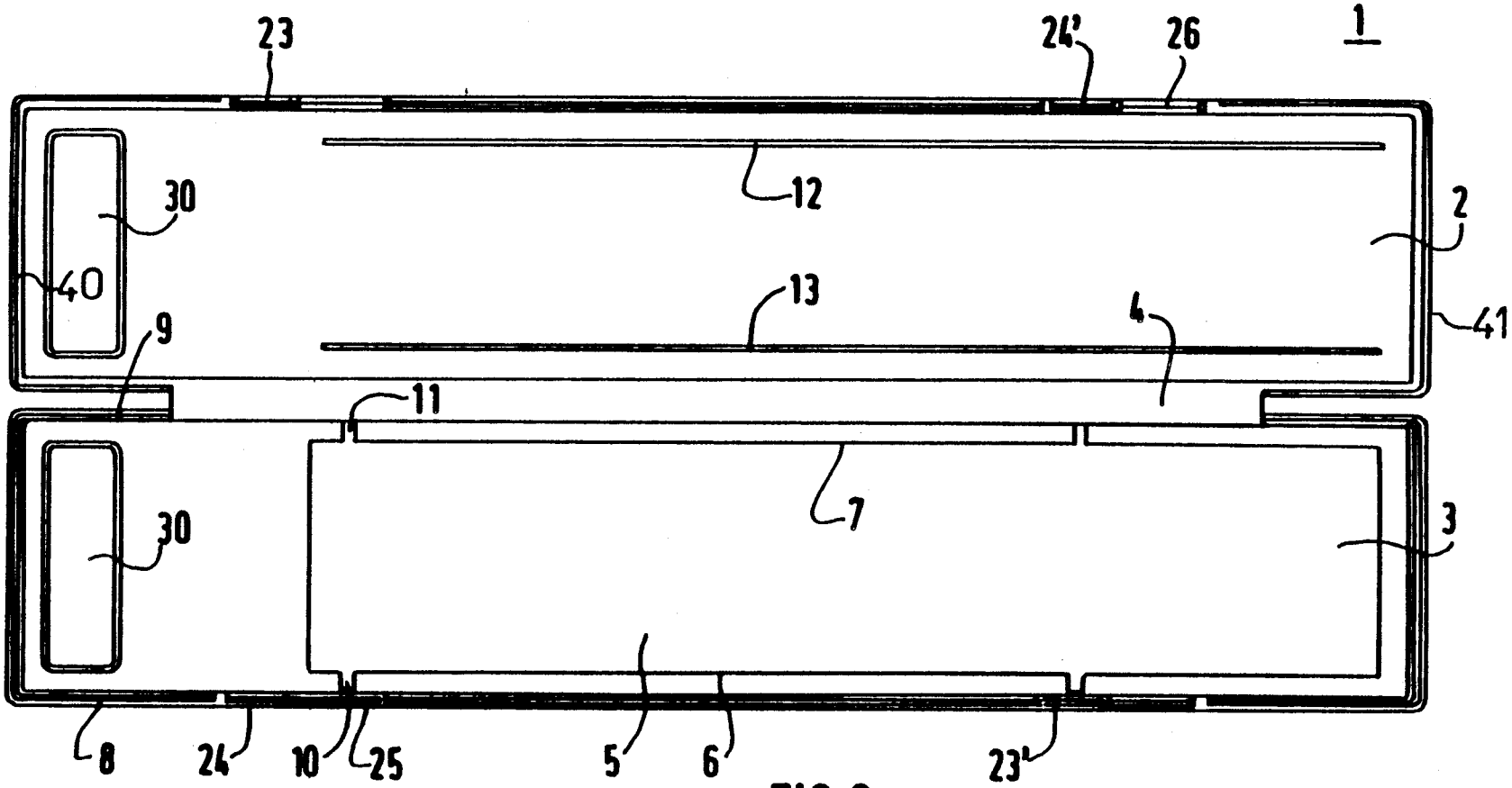
FIG. 2 is a top view of the base arranged next to the lid, their inner faces being visible.
Figure 5:
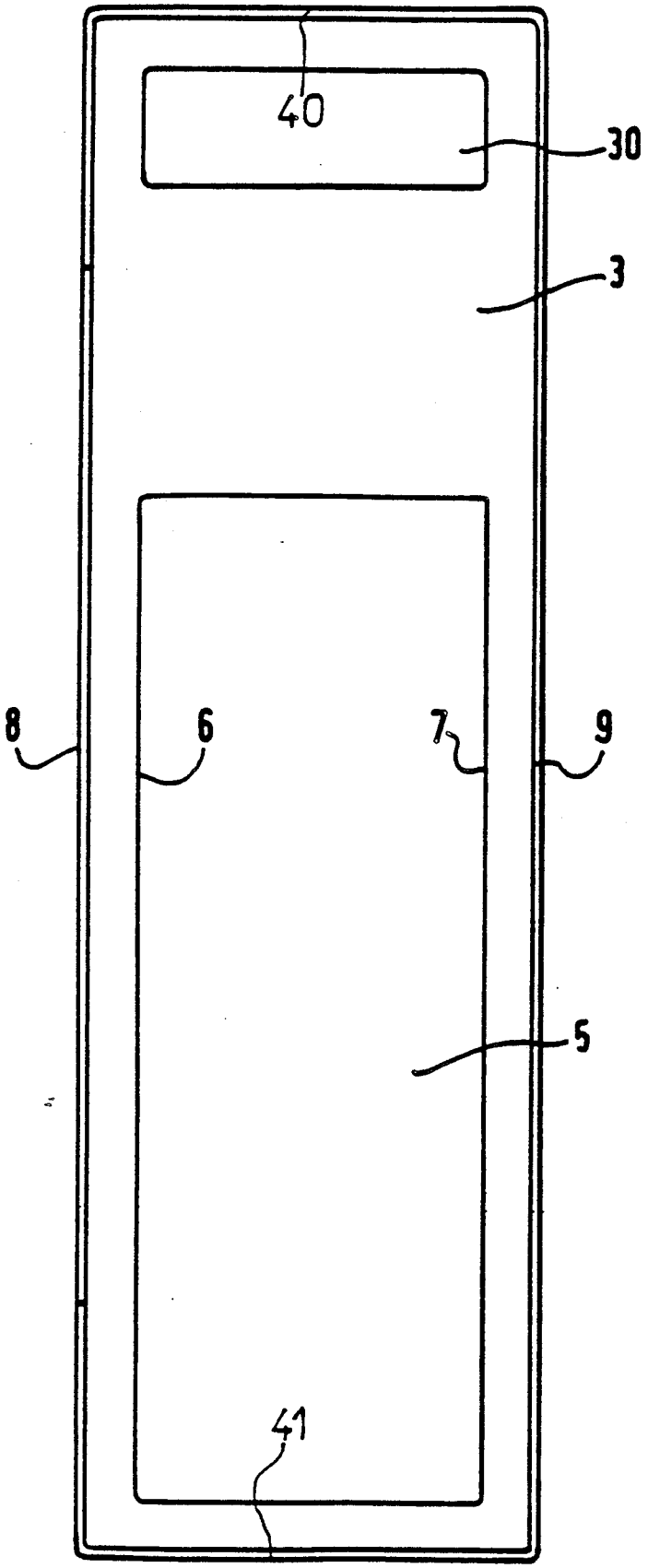
FIG. 5 is a plan view of the base of the box.

The base (3) (see FIGS. 2 and 5) has, over an appreciable part of its length, a concave recess (5), the walls (6, 7) of which are parallel to the longitudinal walls (8, 9) of the box. The general shape of the box (1) and the shape of this recess (5) are substantially rectangular and long and flat. Shims (10, 11) join the walls (6, 7) to the walls (8, 9) in order to further improve the rigidity of the whole.

As already stated, the references (40) and (41) designate the lateral walls forming the top (40) and the bottom (41) of the box (1), of the lid (2) and of the base (3) respectively.

Figure 3:
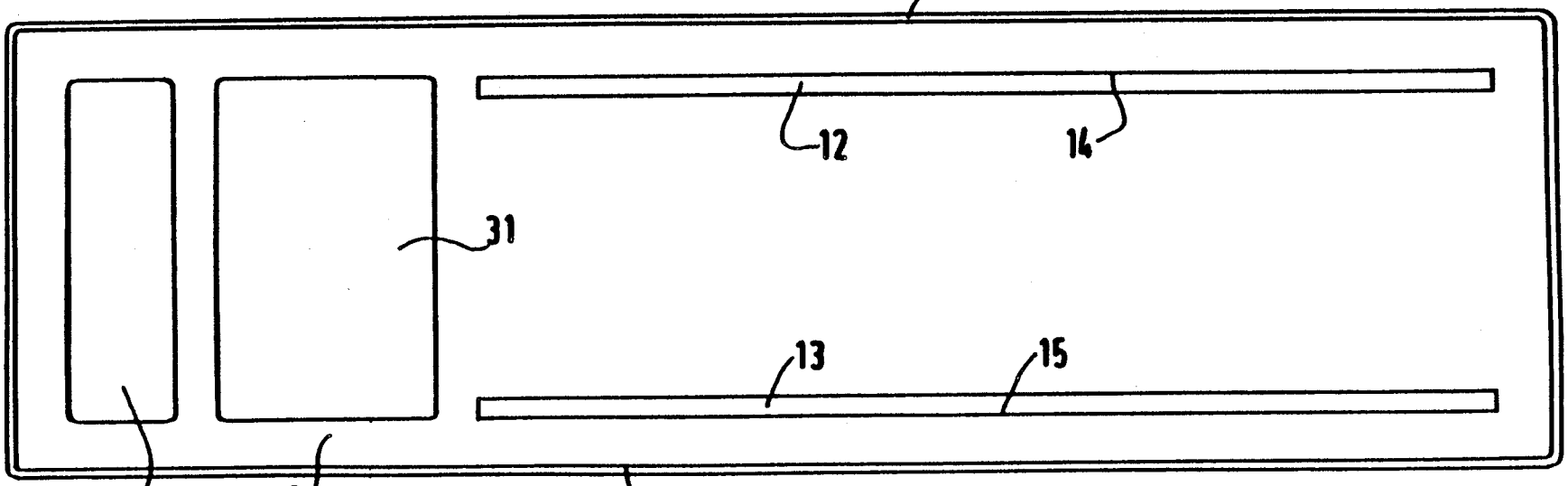

The lid (2) (FIGS. 2 and 3) has two parallel ridges, (12, 13) respectively which are also parallel to the walls (8, 9), the outer walls (14, 15) of which are intended to interact with the inner walls (6, 7) of the recess (5) of the base (3) in order to thus enable several boxes (1) to be stacked on top of each other.

In a known manner, the lid (2) folds down onto the base (3) about the longitudinal molded hinge (4) in order to form a closing line (20) along which the characteristic closing means are arranged.

Figure 4:
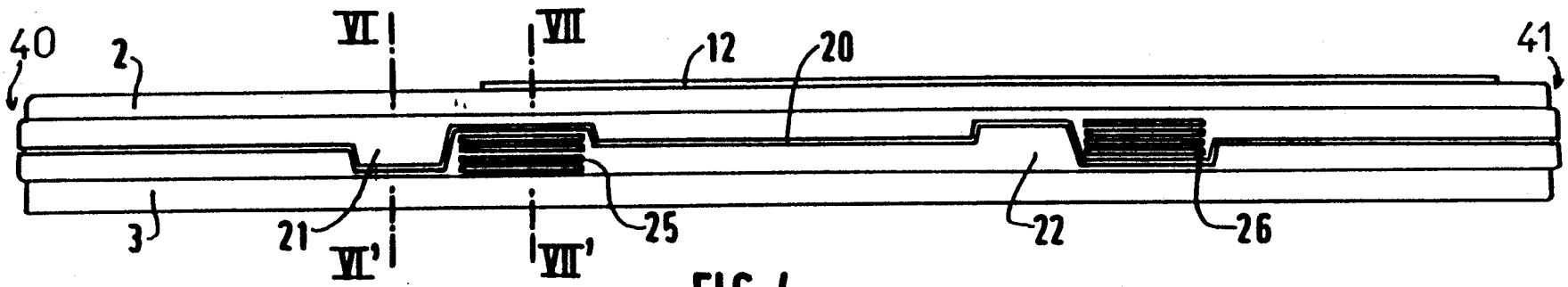
FIG. 4 is a lateral view of the box on the closing line side.
Figure 6:
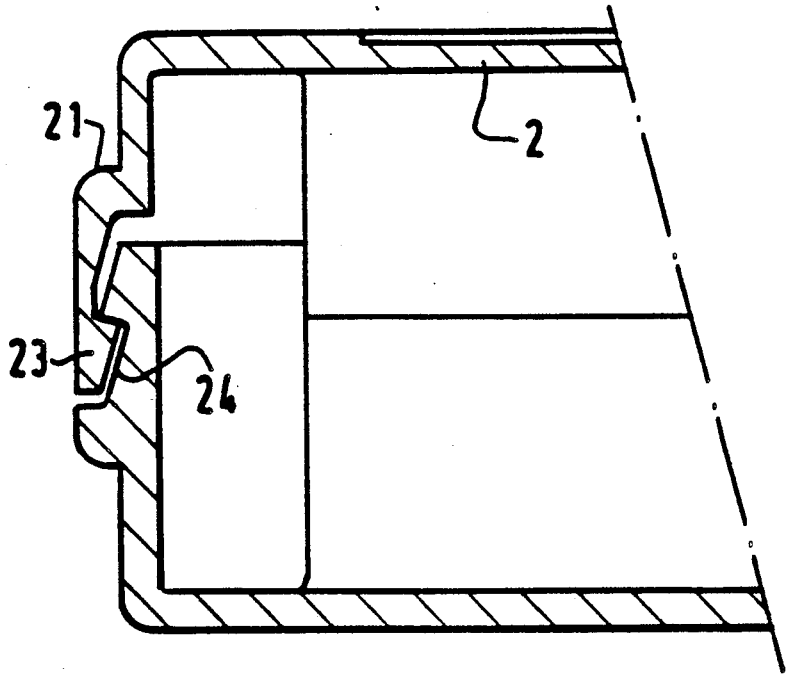
FIGS. 6 and 7 show in detail the closing means, which is a feature of the invention, along the axes VI—VI' and VII—VII' in FIG. 4.
Figure 7:
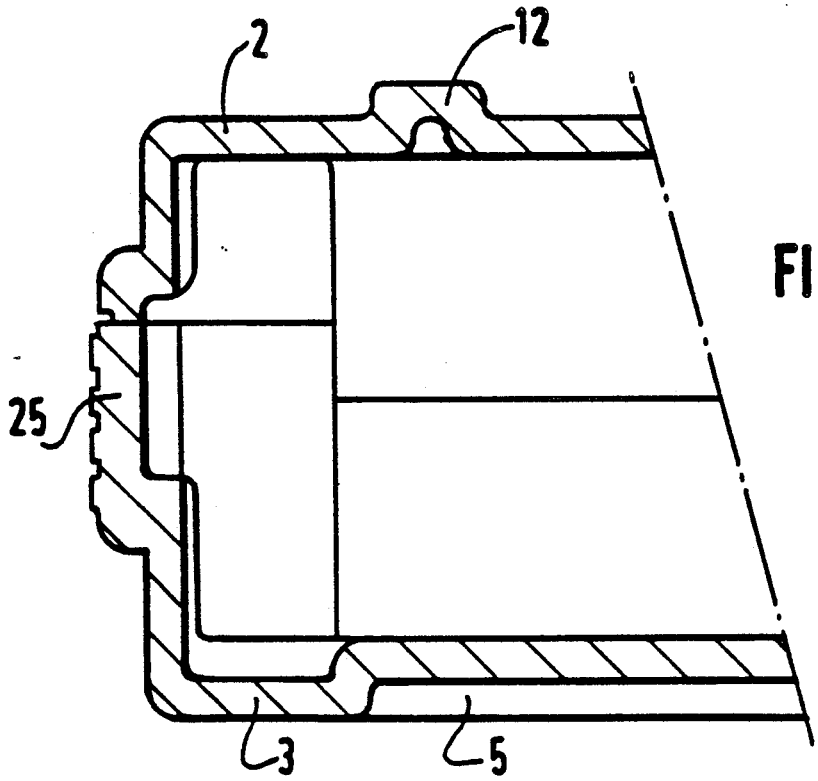

These closing means, designated by the general references (21, 22) (see FIGS. 1, 4 and 6) essentially consist of a molded clip each having a male part (23, 23') which engages in a corresponding female part (24, 24'). Each clip closing means (21, 22), and to be more precise each female part (24, 24'), adjoins and interacts with a bearing surface, (25, 26) respectively see FIG. 7), formed with striations which are parallel to each other and parallel to the closing line (20).

According to an essential feature of the invention, the first closing means (21) is placed on the lid (2) next to the lateral wall of the box defining the top (40), whereas the second closing means (22) is placed on the base (3) and next to the opposite lateral wall defining the bottom (41). The first bearing zone (25) which interacts with the first closing means (21) is for its part placed near the female part (24) of (21) but on the base (3), whereas the second bearing surface (26) is placed near the other female part (24') of the corresponding closing (22) but on the lid (2).

In other words, the two closing means (21, 22) with male (23, 23') and female (24, 24') clips are spaced alternately along the closing line (20), the first (21) arranged towards the top of the box (1) whereas the second (22) is arranged towards the bottom; the characteristic bearing zones (25, 26) associated with the closing clips (21, 22) are, on the other hand, arranged one on the base (3) and the other on the lid (2).

Consequently, when the operator wishes to open the closed box (1), he need only hold it vertically in his hands, with the bottom in his right hand and the top in his left hand respectively, taking care to have the closing line (20) pointing upwards, in other words towards him. He then need only apply pressure with the thumb of his right hand to the bearing surface (26) and with the thumb of his left hand to the bearing surface (25). Because of the elasticity of the plastic, combined with the rigidity of the whole, a simple twisting of the wrists enables the male (23, 23') and female (24, 24') clip catches (23, 24) of the closing means (21, 22) to be released in order to free the lid (2) from the base (3) containing the goods.

In an advantageous variant, the top of the box (1) has on the top (40) an opening (30) which is also molded and intended to form a gripping handle for transport as well as a fastening handle for hanging the box on a display stand.

In another variant, the lid (2) (see FIGS. 1 and 2) has, between the opening (30) and the grooves (12, 13) a zone (31) which forms a space for any identification, such as a label.

The one-piece long and flat packing box according to the invention has numerous advantages as compared with the solutions used up until now, in particular as compared with metal boxes for packing blade for hand saws. The following may be mentioned:

lightness, durability and simplicity;

ease of transporting heavy products;

ease of automatic packing;

possibility of reuse.

These boxes may consequently be employed successfully for packing all long and flat products, in particular blades for hand saws.

I claim:

1. A molded one-piece elongated plastic packing box for packaging elongated members, that includes:

a flat lid and a flat base rotatably supported about a longitudinal hinge disposed along one side of the box and defining between them a closing line arranged on a longitudinal side opposite the hinge;

a first closing means and a second closing means for releasably securing the lid and base together molded in said flat lid and base at spaced apart intervals along the said closing line;

each of said closing means having a male part interacting with a corresponding female part, a pressure bearing surface operatively connected to one of said male or female parts in each of said first and second closing means, and said second closing means and its bearing surface together being inverted, relative to said first closing means and its bearing surface; so that under the application of pressure on the bearing surfaces of said first and second closing means, the lid is released from the base.

2. The molded packing box as claimed in claim 1 wherein the bearing surface of the first closing means is joined to the male part, and the male part is formed in the base next to the top of the box; and the bearing surface of the second closing means is joined to the second male part and formed in the lid next to the bottom of the box so that pressure on the bearing surface of one closing means by the left hand and the other by the right hand will simultaneously release the closing means and open the packing box.

3. The molded packing box as claimed in claim 1 wherein the base has a recess over an appreciable part of its length, the lid has two raised parallel, ridges and the outer walls of the ridges interact with the inner walls of the recess of the base to permit the stacking of several boxes on top of each other and adjacent one end of the box an opening is formed to provide a gripping handle and a display hanging aperture.

* * * * *